US006467720B1

(12) United States Patent
Madrzak et al.

(10) Patent No.: US 6,467,720 B1
(45) Date of Patent: Oct. 22, 2002

(54) PROCESS FOR WINDING A MATERIAL WEB AND WINDING MACHINE FOR PERFORMING THE PROCESS

(75) Inventors: Zygmunt Madrzak, Heidenheim (DE); Matthias Wohlfart, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/519,350

(22) Filed: Mar. 6, 2000

(30) Foreign Application Priority Data

Mar. 10, 1999 (DE) ..... 199 10 566

(51) Int. Cl.[7] ..... B65H 35/08

(52) U.S. Cl. ..... 242/526.3; 242/532.3; 242/541

(58) Field of Search ..... 242/526, 526.3, 242/532.3, 541

(56) References Cited

U.S. PATENT DOCUMENTS

| | | | | |
|---|---|---|---|---|
| 3,794,255 A | | 2/1974 | Harmon et al. | |
| 4,326,680 A | | 4/1982 | Tetro et al. | |
| 4,444,362 A | | 4/1984 | Karr | |
| 5,213,649 A | * | 5/1993 | Sepavich et al. | 242/526.3 |

FOREIGN PATENT DOCUMENTS

| | | |
|---|---|---|
| DE | 1092292 | 4/1961 |
| DE | 2721883 | 11/1978 |
| DE | 85126993 | 7/1986 |
| DE | 91037492 | 8/1991 |
| DE | 4208746 | 5/1993 |
| DE | 9407262.0 | 8/1994 |
| EP | 0089304 | 9/1983 |
| EP | 543788 | 5/1993 |
| FR | 1397452 | 12/1965 |
| WO | 92/06913 | 4/1992 |
| WO | 97/48632 | 12/1997 |

OTHER PUBLICATIONS

Keller, "Papierschneiden Mit Laser", Papier & Kunstoff–Verarbeiter pp. 32–39 (Jul. 1992).

* cited by examiner

*Primary Examiner*—John Q. Nguyen
(74) *Attorney, Agent, or Firm*—Greenblum & Bernstein, P.L.C.

(57) ABSTRACT

Process and winding machine for winding a material web onto a reel spool. The winding machine includes the winding machine includes a carrier drum, such that the carrier drum and the reel spool are arranged to form a winding nip. Two separation elements are positionable in a region of the two edges of the material web and at a distance from the respective edge of the material web. A device is included for moving the two separation elements cross-wise to a web travel direction and at least to a center of the web while the material web is running. In this manner, the two separation elements are adapted to form edge strips. The process includes guiding the material web over the carrier drum, positioning the two separating elements in a region of the two edges of the material web and at a distance from the respective edges of the material web, cutting the material web, in preparation of a reel spool change, by moving the two separating elements cross-wise to a web travel direction at least to the center of the web while the material web is running, thereby forming strips at the respective edges, and separating the cut material web.

20 Claims, 2 Drawing Sheets

PROCESS FOR WINDING A MATERIAL WEB AND WINDING MACHINE FOR PERFORMING THE PROCESS

CROSS-REFERENCE TO RELATED APPLICATIONS

The present application claims priority under 35 U.S.C. §119 of German Patent Application No. 199 10 566.9, filed on Mar. 10, 1999, the disclosure of which is expressly incorporated by reference herein in its entirety.

BACKGROUND OF THE INVENTION

1. Field of the Invention

The present invention relates to a process for winding a material web, e.g., a paper or cardboard web, in which the material web is guided over a carrier drum, a winding nip is formed between the carrier drum and the reel spool, and the material web is separated for each reel spool change. The invention further relates to a winding machine that include a carrier drum, a winding nip formed between the carrier drum and the reel spool, and a device for separating the material web for each reel spool change.

2. Discussion of Background Information

A winding machine, similar to the one generally discussed above, is used, e,g., at the end of a machine, for producing or processing a material web. It can also be used, e.g., to rewind a wound roll that has already been wound. The machine can be, e.g., a paper, cardboard or tissue machine.

Various devices for separating a material web for a reel spool change are known. As a result, water jet nozzles operating with high pressure are currently increasingly being used in addition to Gooseneck and Randkobra devices. A disadvantage of the Gooseneck and Randkobra devices is that the material web cannot be guided neatly onto the new, still empty reel spool. In addition, separating with air does not guarantee a clean cut which, particularly in the case of heavy, longitudinally oriented paper, can cause the web not to tear over the entire width, and for only a longitudinal tear to occur after separation of a part of the web. In addition, the Gooseneck has the disadvantage that it requires expensive devices in order to be able to swing the blast nozzle into the center of the web between the full and the new, still empty reel spool.

SUMMARY OF THE INVENTION

The present invention provides a process and winding machine of the type generally discussed above, which also ensures a safest possible separation process with minimal structural expense.

Regarding the process, the invention provides that the material web is cut by two separating elements that can generally be moved cross-wise (transverse) to the web travel direction. The two separating elements are arranged in an area of the two edges of the web, and at a distance from the respective edges, to form a strip, and subsequently moved at least to the center of the web while the material web is running.

The winding machine according to the present invention includes two separating elements, which can generally be moved cross-wise to the web travel direction, and which can be arranged to cut the material web in the area of the two edges of the web, and at a distance from respective edges of the web, to form a strip. The two separating elements can be subsequently moved at least to the center of the web while the material web is running.

The separating elements can be, e.g., cutting elements.

Due to this arrangement, all extremely safe and reliable separation procedure can be ensured with every reel spool change, reducing the structural expense required therefor to a minimum.

It can be advantageous for separating elements which operate in a contact-free manner to be utilized as separating elements, e.g., water jet or laser beam separating elements.

In certain cases, it lay be appropriate for the material web to be cut before the carrier drum, relative to a web travel direction, by the separating elements.

In an appropriate alternative embodiment, the material web can be cut on the carrier drum by the separating elements.

In the case where the material web is cut by the separating elements before or on the carrier drum, it may be advantageous for the material web to be cut such that cutting lines created by the two separating elements overlap in an area of the center of the web.

If the cutting procedure occurs with a full reel spool adjacent to the carrier drum, each strip can be separated in an area on the carrier drum lying between a new, still empty reel spool and the full reel spool. In so doing, each strip can be separated by a blast nozzle, a doctor or a water jet.

If the cutting procedure occurs with a full reel spool arranged at a distance from the carrier drum, each strip can be separated in the open area between the new, still empty reel spool and the full reel spool. In so doing, each strip can be separated by a blast nozzle, a waterjet or a moveable element, e.g., an impact cutter.

In certain cases, it may be appropriate for each strip to be separated by an adhesive element, e.g., a double-sided adhesive band, inserted into the winding nip between the carrier drum and the new reel spool and arranged to act on both sides.

Generally, the material web can be cut on the new, still empty reel spool by the two separating elements.

In another appropriate embodiment, the material web can be cut after the carrier drum, relative to the web travel direction, by the separating elements. In so doing, the material web may be appropriately cut such that the cutting lines created by the two separating elements overlap in the area of the center of the web.

A double-sided adhesive band can be used, e.g., to support the winding of the first layers on the new reel spool.

The present invention is directed to a process for winding a material web onto a reel spool in an apparatus that includes a carrier drum positioned to form a winding nip with the reel spool, and two separating elements. The process includes guiding the material web over the carrier drum, positioning the two separating elements in a region of the two edges of the material web and at a distance from the respective edges of the material web, cutting the material web, in preparation of a reel spool change, by moving the two separating elements cross-wise to a web travel direction at least to the center of the web while the material web is running, thereby forming strips at the respective edges, and separating the cut material web.

In accordance with a feature of the instant invention, the material web may be one of a paper and cardboard web.

According to another feature of the invention, the two separating elements can operate in a contact-free manner. Further, the two separating elements can include at least one of a water jet and a laser beam separating element.

In accordance with another feature of the present invention, the two separating elements can be positioned to cut the material web before, relative to the web travel direction, the carrier drum.

According to still another feature of the invention, the two separating elements can be positioned to cut the material web at a position where the material web is supported on the carrier drum.

In accordance with a further feature of the present invention, cutting lines created by the two separating elements can be arranged to overlap in a region of a center of the material web.

Further, the reel spool can be a full reel spool, the cutting can occur while the full reel spool is positioned adjacent to the carrier drum to form the winding nip, and the separation can occur in a region in where the material web is supported on the carrier drum. Moreover, the process can further include positioning a new, still empty reel spool against the carrier drum to form a new winding nip. Separation may occur in a region between the new, still empty reel spool and the full reel spool. In this regard, each strip can be separated by one of a blast nozzle, a doctor and a water jet.

Still further, the reel spool can be a full reel spool, and the process can further include moving the full reel spool away from the carrier drum, whereby the winding nip is opened, The cutting may occur while the full reel spool is positioned away from the carrier drum, and the separation can occur in an open area in which the material web is not supported. The process can also include positioning a new, still empty reel spool against the carrier drum to form a new winding nip. Separation may occur in a region between the new, still empty reel spool and the full reel spool. In this regard, each strip can be separated by one of a blast nozzle, a water jet and a moveable element. The moveable element can include an impact cutter.

According to a still further feature of the instant invention, the apparatus can further include at least one adhesive element, and process may further include inserting the at least one adhesive element into the winding nip between the carrier drum and a new reel spool to be wound, so that the at least one adhesive element may act on both sides, and separating the strips with the at least one adhesive element, Further, the at least one adhesive element can include a double-sided adhesive band.

In accordance with another aspect of the invention, the process can further include positioning a new, still empty reel spool against the carrier drum to form a new winding nip. The two separating elements may be positioned to cut the material web in a position where the material web is in contact with the new, still empty reel spool.

The two separating elements may be positioned to cut the material web after, relative to the web travel direction, the carrier drum. Cutting lines created by the two separating elements can be arranged to overlap in a region of a center of the web.

According to still another aspect of the invention, the apparatus can further include a double-sided adhesive band, and the process may further include supporting the winding of the first layers on the new reel spool with the double-sided adhesive band.

The present invention is directed to a winding machine for winding a material web onto a reel spool. The winding machine includes a carrier drum, such that the carrier drum and the reel spool are arranged to form a winding nip. Two separation elements are positionable in a region of the two edges of the material web and at a distance from the respective edge of the material web. A device is included for moving the two separation elements cross-wise to a web travel direction and at least to a center of the web while the material web is running. In this manner, the two separation elements are adapted to form edge strips.

According to a feature of the invention, the material web can be one of a paper and a cardboard web.

In accordance with another feature of the instant invention, the two separating elements can operate in a contact-free manner. The two separating elements can include at least one of a water jet and a laser beam separating element.

According to still another feature of the present invention, the two separating elements can be positioned before, relative to the web travel direction, the carrier drum. The two separating elements may be adapted to create cutting lines which overlap in a region of a center of the web.

In accordance with still another feature of the invention, the two separating elements may be arranged to cut the material web at position where the material web is supported on the carrier drum. The two separating elements can be adapted to create the cutting lines which overlap in a region of a center of the web.

The reel spool can be a full reel spool which is positioned adjacent the carrier drum to form the winding nip, and at least one strip separating device may be positioned to separate each strip in a region where the material web is supported on the carrier drum. A new, still empty reel spool can be positioned against the carrier roll to from a new winding nip, and the region where the material web is supported on the carrier drum is between the new, still empty reel spool and the full reel spool. The at least one separating device can include at least one of a blast nozzle, a doctor, and a water jet.

The reel spool can be a new, still empty reel spool, a full reel spool can be located at a distance from the carrier drum, and at least one separating device can be provided for separating the strips in an open area in which the material web is unsupported. The open area can be located between the new, still empty reel spool and the full reel spool. The at least one separating device may include at least one of a blast nozzle, a waterjet separating element, and a moveable element. The moveable element comprises an impact cutter.

According to another aspect of the instant invention, the reel spool can be a new, still empty reel spool, and the two separating elements can be arranged to cut the material web where the material web contacts the new, still empty reel spool. The two separating elements may be adapted to create cutting lines which overlap in a region of a center of the web.

In accordance with a further aspect of the present invention, the two separating elements can be arranged after, relative to the web travel direction, the carrier drum. The two separating elements may be adapted to create cutting lines which overlap in a region of a center of the web.

The present invention is directed to a process for winding a material web onto a reel spool in an apparatus that includes a carrier drum positioned to form a winding nip with the reel spool, and at least one separating element. The process includes guiding the material web over the carrier drum, positioning the at least one separating element in a region of one of the edges of the material web and at a distance from the one edge, cutting the material web, in preparation of a reel spool change, by moving the at least one separating element cross-wise to a web travel direction to a position such that at least two edge strips are formed, and separating the at least two edge strips.

According to another feature of the invention, the at least one separating element can include at least one of a water jet and a laser beam separating element.

In accordance with still another feature of the present invention, the at least one separating element is positioned to cut the material web before, relative to the web travel direction, the carrier drum.

Further, the at least one separating element can be positioned to cut the material web at a position where the material web is supported on the carrier drum.

Still further, the process can include positioning a new, still empty reel spool against the carrier drum to form a new winding nip, and the at least one separating element can be positioned to cut the material web in a position where the material web is in contact with the new, still empty reel spool.

The at least one separating element may be positioned to cut the material web after, relative to the web travel direction, the carrier drum.

The at least one separating element can include two separating elements positioned in opposite edge regions, and the two separating elements may form cutting lines which intersect in a center region of the material web.

The present invention is directed to a winding machine for winding a material web onto a reel spool. The winding machine includes a carrier drum, in which the carrier drum and the reel spool are arranged to form a winding nip, at least one separation element that is positionable in a region of one of the edges of the material web and at a distance from the one edge, and a device for moving the at least one separation element cross-wise to a web travel direction, such that the at least one separation element is adapted to form at least two edge strips while the material web is running.

According to a feature of the present invention, the at least one separating element can include at least one of a water jet and a laser beam separating element.

In accordance with another feature of the invention, the at least one separating element may be positioned before, relative to the web travel direction, the carrier drum.

According to still another feature of the present invention, the at least one separating element can be arranged to cut the material web at position where the material web is supported on the carrier drum.

Further, the reel spool can be a new, still empty reel spool, and the at least one separating element may be arranged to cut the material web where the material web contacts the new, still empty reel spool.

Still further, the a least one separating element can be arranged after, relative to the web travel direction, the carrier drum.

In accordance with yet another feature of the present invention, the at least one separating element can include two separating elements positionable in opposite edge regions, and the two separating elements may be adapted to form cutting lines which intersect in a center region of the material web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
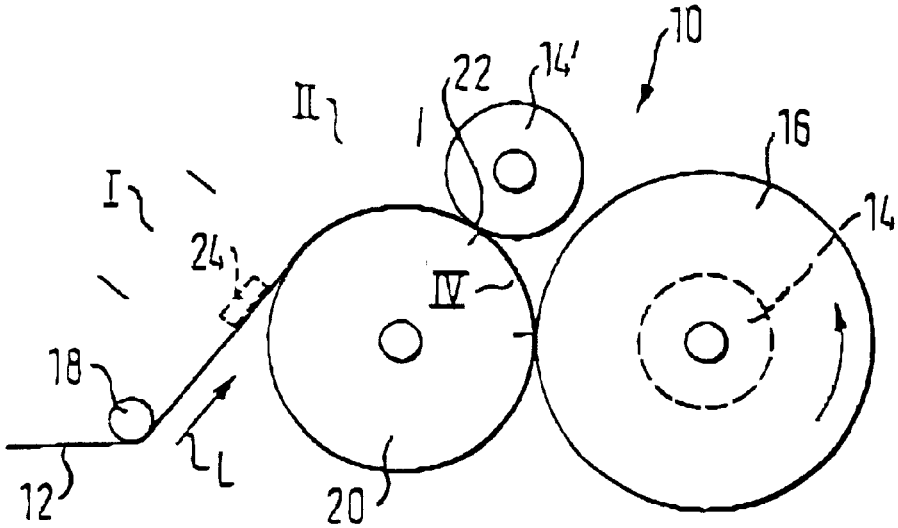
FIG. 1 schematically illustrates an exemplary embodiment of a winding machine in which a cutting procedure occurs with a full reel spool adjacent to the carrier drum.

FIG. 1 schematically illustrates an embodiment of a winding machine 10 according to the present invention for winding a material web 12, e.g., a paper or cardboard web, onto reel spools 14 and 14'. Therefore, winding machine 10 can be provided at the end of a paper, cardboard or tissue machine.

To produce a wound roll 16, material web 12 is guided over a carrier drum 20 positioned after or downstream of, relative to web travel direction L, a spreader roll 18. Carrier drum 20 can be arranged to form a winding nip 22 with an empty reel spool 14' and/or with wound roll 16 being created on reel spool 14, which has already begun winding. Carrier drum 20 and wound roll 16 being created are held in contact with one another during the winding procedure in order to maintain winding nip 22.

FIG. 1 illustrates a winding machine 10 in an operating phase directly before a reel spool change for which material web 12 must be separated. In the present case, finished wound roll 16, i.e., full reel spool 14 is positioned adjacent to carrier drum 20. The new, still empty reel spool 14' is kept ready diagonally above carrier drum 20. A winding nip 22 is also formed between carrier drum 20 and new reel spool 14', Carrier drum 20, full reel spool 14, and new reel spool 14' can each be preferably driven by a center drive.

Winding machine 10 can be include, at various locations, a cutting device 24, which can, e.g., operate in a contact-free manner. In the exemplary embodiment of FIG. 1, cutting device 24 is shown arranged in zone I, i.e., before or upstream of carrier drum 20, relative to web travel direction L. As an alternative, cutting device 24, which can operate, e.g., a contact-free manner, may be arranged on carrier drum 20, i.e., in zone II of FIG. 1, so that separation 12 occurs where web 12 is supported on carrier drum 20.

Figure 2:
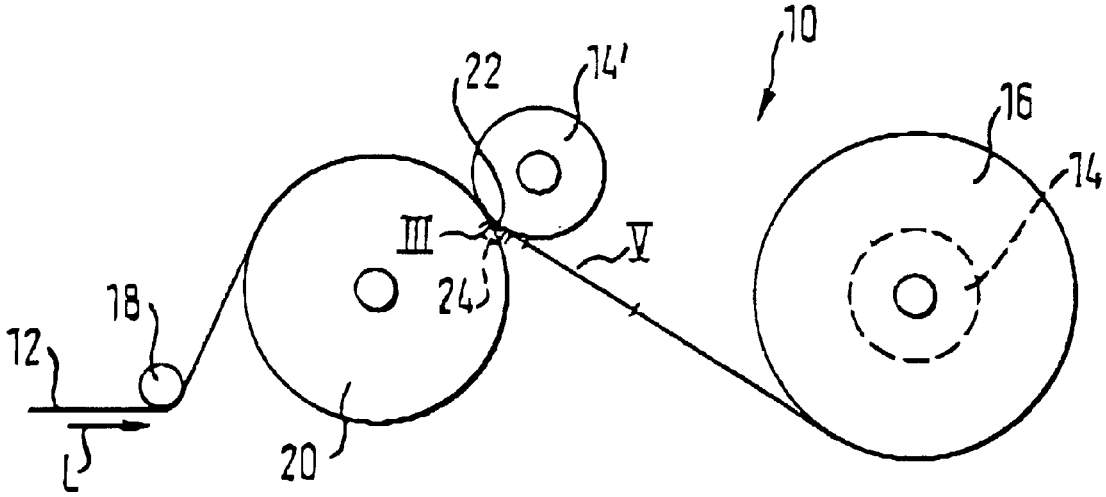
FIG. 2 schematically illustrates another exemplary embodiment of a winding machine in which the cutting procedure occurs with the full reel spool arranged at a distance from the carrier drum.

FIG. 2 schematically illustrates another embodiment of winding machine 10. Winding machine 10 is again depicted in an operating phase directly before a reel spool change for which material web 12 must be separated. In this embodiment, however, finished wound roll 16, or full reel spool 14, has been removed from carrier drum 20, and is located in a change position.

Therefore, the cutting procedure occurs in the instant embodiment with a full reel spool arranged at a distance from carrier drum 20.

Otherwise, this exemplary embodiment has at least essentially the same structure as depicted in FIG. 1. Therefore, parts that correspond to one another are provided with the same reference characters. Winding machine 10 can also be provided with cutting device 24, which can operate, e.g., in a contact-free manner. In this embodiment, cutting device 24 can be located in zone III, e.g., so that separation occurs where web 12 is on new, still empty reel spool 14'.

Figure 3:
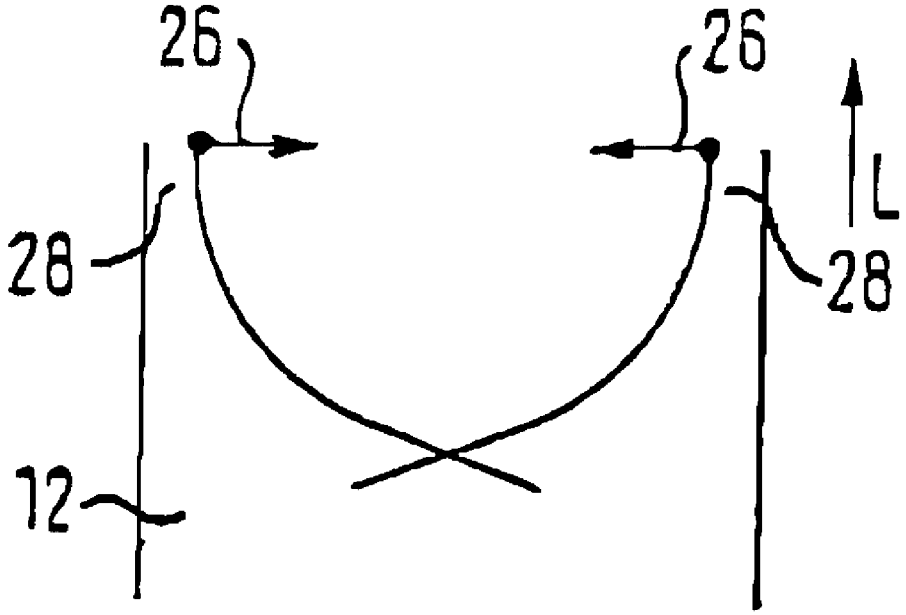
FIG. 3 schematically illustrates an embodiment of a cutting procedure in which the material web is cut before or one the carrier drum, relative to a web travel direction, by two separating elements.

Cutting device 24, which can be utilized with the above-described embodiments, includes at least one separating element 26 that can generally be moved cross-wise (transverse) to web travel direction L (see also FIG. 3). Separating element 26 can operate, e.g., a contact-free manner, and can be formed by, e.g., a water jet or laser beam.

In the exemplary embodiment depicted in FIG. 3, two separating elements 26 are arranged in an area of the two edges of the web and can subsequently be moved at least to the center of the web while material web 12 is running. It is further noted that one separating element, which moves cross-wise to the web travel direction from one edge region to the other edge region, can be utilized to form edge strips 28.

FIG. 3 schematically illustrates an exemplary embodiment of a cutting procedure in which material web 12 is cut before, relative to web travel direction L, or where it is supported on carrier drum 20. As shown, two separating elements 26 can be used. In so doing, separating elements 26 can be arranged in an area of the two edges of the web, e.g., at a distance from the edges of web 12, thereby forming strips 28. Separating elements 26 can be subsequently moved at least to the center of web 12, and, as depicted in the illustrated embodiment, material web 12 can be cut such that the cutting lines created by separating elements 26 overlap in the area of the center of web 12.

If the cutting procedure takes place with full reel spool 14 adjacent to carrier drum 20, as depicted in FIG. 1, strip (or strips) 28 can be separated in area IV, i.e., where strip(s) 28 are supported on carrier drum 20, between new, still empty reel spool 14' and full reel spool 14. In so doing, strip(s) 28 can be separated by, e.g., a blast nozzle, a doctor or a water jet.

Alternatively, if the cutting procedure takes place with full reel spool 14 arranged at a distance from carrier drum 20, as depicted in FIG. 2, strip (or strips) 28 can be separated in open area V, i.e., where strip(s) 28 are not supported, between new, still empty reel spool 14' and full reel spool 14. In so doing, strip 28 can be separated by, e.g., a blast nozzle, a waterjet or a moveable element, such as an impact cutter.

Generally, strip(s) 28 can also be separated by an adhesive element e g., a double-sided adhesive band inserted into winding nip 22 between carrier drum 20 and new reel spool 14' and acting on both sides. The double-sided adhesive band can be used, e.g., to support the winding of the first layers on new reel spool 14'.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to full functionally equivalent structures, methods and uses, such as are within the scope of the appended claims.

LIST OF REFERENCE CHARACTERS

10 winding machine
12 material web
14 full reel spool
14' new, still empty reel spool
16 wound roll
18 spreader roll
20 carrier drum
22 winding nip
24 cutting device
26 separating element
28 strip
I–IV areas
L web travel direction

What is claimed:

1. A process for winding a material web onto a reel spool in an apparatus that includes a carrier drum positioned to form a winding nip with the reel spool, and two separating elements, the process comprising:

guiding the material web over the carrier drum;

positioning the two separating elements in a region of the two edges of the material web and at a distance from the respective edges of the material web;

cutting the material web, in preparation of a reel spool change, by moving the two separating elements cross-wise to a web travel direction at least to the center of the web while the material web is running, thereby forming strips at the respective edges; and separating the cut material web.

2. The process in accordance with claim 1, wherein the material web is one of a paper and cardboard web.

3. The process in accordance with claim 1, wherein the two separating elements operate in a contact-free manner.

4. The process in accordance with claim 3, wherein the two separating elements comprise at least one of a water jet and a laser beam separating element.

5. The process in accordance with claim 1, wherein the two separating elements are positioned to cut the material web before, relative to the web travel direction, the carrier drum.

6. The process in accordance with claim 1, wherein the two separating elements are positioned to cut the material web at a position where the material web is supported on the carrier drum.

7. The process in accordance with claim 1, wherein cutting lines created by the two separating elements are arranged to overlap in a region of a center of the material web.

8. The process in accordance with claim 1, wherein the reel spool comprises a full reel spool, wherein the cutting occurs while the full reel spool is positioned adjacent to the carrier drum to form the winding nip, and wherein the separation occurs in a region where the material web is supported on the carrier drum.

9. The process in accordance with claim 8, further comprising positioning a new, still empty reel spool against the carrier drum to form a new winding nip, wherein separation occurs in a region between the new, still empty reel spool and the full reel spool.

10. The process in accordance with claim 8, wherein each strip is separated by one of a blast nozzle, a doctor and a water jet.

11. The process in accordance with claim 1, wherein the reel spool comprises a full reel spool, and the process further comprises:

moving the full reel spool away from the carrier drum, whereby the winding nip is opened, wherein the cutting occurs while the full reel spool is positioned away from the carrier drum, and wherein the separation occurs in an open area in which the material web is not supported.

12. The process in accordance with claim 11, further comprising positioning a new, still empty reel spool against the carrier drum to form a new winding nip, wherein separation occurs in a region between the new, still empty reel spool and the full reel spool.

13. The process in accordance with claim 11, wherein each strip is separated by one of a blast nozzle, a water jet and a moveable element.

14. The process in accordance with claim 13, wherein the moveable element comprises an impact cutter.

15. The process in accordance with claim 1, wherein the apparatus further includes at least one adhesive element, and said process further comprises:

inserting the at least one adhesive element into the winding nip between the carrier drum and a new reel spool to be wound, wherein the at least one adhesive element acts on both sides; and separating the strips with the at least one adhesive element.

16. The process in accordance with claim 15, wherein the at least one adhesive element includes a double-sided adhesive band.

17. The process in accordance with claim 1, further comprising positioning a new, still empty reel spool against the carrier drum to form a new winding nip, wherein the two separating elements are positioned to cut the material web in a position where the material web is in contact with the new, still empty reel spool.

18. The process in accordance with claim 1, wherein the two separating elements are positioned to cut the material web after, relative to the web travel direction, the carrier drum.

19. The process in accordance with claim 18, wherein cutting lines created by the two separating elements are arranged to overlap in a region of a center of the web.

20. The process in accordance with claim 1, wherein the apparatus further includes a double-sided adhesive band, and the process further comprises supporting the winding of the first layers on the new reel spool with the double-sided adhesive band.

* * * * *